US011074834B1

(12) United States Patent
Flowers et al.

(10) Patent No.: US 11,074,834 B1
(45) Date of Patent: Jul. 27, 2021

(54) FIRE PROTECTION SPRINKLER CONCEALMENT ASSEMBLY HAVING AN EXTERNAL INDICIA

(71) Applicant: Minimax Viking Research & Development GmbH, Bad Oldesloe (DE)

(72) Inventors: Darci Ann Flowers, Hastings, MI (US); Lindsay Marie Barker, Delton, MI (US)

(73) Assignee: Minimax Viking Research & Development GmbH, Bad Oldesloe (DE)

( * ) Notice: Subject to any disclaimer, the term of this patent is extended or adjusted under 35 U.S.C. 154(b) by 0 days.

(21) Appl. No.: 16/820,511

(22) Filed: Mar. 16, 2020

Related U.S. Application Data

(60) Provisional application No. 62/821,795, filed on Mar. 21, 2019.

(51) Int. Cl.
*G09F 7/18* (2006.01)
*G09F 7/16* (2006.01)
*A62C 35/68* (2006.01)

(52) U.S. Cl.
CPC ..... *G09F 7/18* (2013.01); *A62C 35/68* (2013.01); *G09F 7/165* (2013.01); *G09F 2007/186* (2013.01)

(58) Field of Classification Search
CPC ..... G09F 7/18; G09F 7/165; G09F 2007/186; A62C 35/68
See application file for complete search history.

(56) References Cited

U.S. PATENT DOCUMENTS 5,152,344 A * 10/1992 Fischer ..... A62C 37/08 169/37
5,372,203 A * 12/1994 Galaszewski ..... A62C 37/14 169/37
6,082,463 A * 7/2000 Ponte ..... A62C 37/09 169/41
6,805,203 B2 * 10/2004 Retzloff ..... A62C 37/09 169/37
6,840,329 B2 * 1/2005 Kikuchi ..... A62C 37/09 169/37
8,176,987 B2 * 5/2012 Rekeny ..... A62C 37/12 169/38

(Continued)

FOREIGN PATENT DOCUMENTS

JP 2003265642 A 9/2003
JP 2016106656 A 6/2016

OTHER PUBLICATIONS

Twitter post "we can print anything . . . "1 page, posted Jul. 19, 2017 by user "@Senju Sprinkler". [retrieved Sep. 23, 2020]Retrieved from Internet: <https://twitter.com/SenjuSprinkler/status/887747205653712896.

(Continued)

*Primary Examiner* — Gary C Hoge
(74) *Attorney, Agent, or Firm* — Perkins Coie LLP

(57) ABSTRACT

Concealment assemblies for fire protection sprinklers. The concealment assembly includes a cover member having an external surface with a base coating of uniformly applied polymer. One or more different polymer coatings are disposed in a discontinuous manner over the base polymer to provide a visual contrast and form desired indicia.

27 Claims, 3 Drawing Sheets

(56) References Cited

U.S. PATENT DOCUMENTS

| | | | | |
|---|---|---|---|---|
| 2004/0134670 | A1* | 7/2004 | Orr | A62C 31/28 169/37 |
| 2007/0215720 | A1* | 9/2007 | Koiwa | A62C 37/09 239/201 |
| 2008/0115948 | A1* | 5/2008 | Koiwa | A62C 37/11 169/38 |
| 2009/0218109 | A1* | 9/2009 | Sato | A62C 37/14 169/37 |
| 2013/0020406 | A1* | 1/2013 | Koiwa | B25B 13/06 239/209 |
| 2014/0158383 | A1* | 6/2014 | Hansen | A62C 37/08 169/46 |
| 2015/0013131 | A1* | 1/2015 | Koiwa | A62C 35/68 29/278 |
| 2015/0083442 | A1* | 3/2015 | Koiwa | A62C 37/08 169/37 |
| 2015/0136432 | A1* | 5/2015 | Chen | A62C 35/68 169/57 |
| 2016/0030785 | A1* | 2/2016 | Ringer | A62C 35/64 169/41 |
| 2017/0007869 | A1* | 1/2017 | Ohkoshi | A62C 35/68 |
| 2017/0095683 | A1* | 4/2017 | Chen | F16F 1/322 |
| 2017/0326393 | A1* | 11/2017 | Oldham | A62C 35/68 |

OTHER PUBLICATIONS

The Viking Corporation, Technical Data, "FREEDOM® Residential Concealed Pendent Sprinkler VK457 (K4.9)", Form No. F_072607 Rev 14.1, Date Unknown, 6 pages.

Senju Sprinkler, Custom Finishes Cover Plates, [online] Senju Sprinkler News, 2014, 1 page, [retrieved Sep. 12, 2019], Retrieved from the Internet: <https://www.senjusprinkler.com/custom-finishes-cover-plates/.

Fire Sprinkler Podcast on Twitter, 1 page, posted Aug. 19, 2019 by user "Fire Sprinkler Podcast @firesprkpodcast". [retrieved Mar. 5, 2021]—Retrieved from Internet: https://twitter.com/firesprkpodcast/status/1163572955437289472.

Integrated Fire Systems, Inc., News & Updates, Painted Fire Sprinkler Heads and Concealed Escutcheons Feb. 15, 2018, 4 pages,—Retrieved from Internet: https://www.integratedfiresystems.com/painted-fire-sprinkler-heads-concealed-escutcheons/.

Quick Response Fire Supply LLC, Thoughts on Fire Blog, #14, "Can I Paint My Fire Sprinkler Cover Plate", Mar. 12, 2013, 6 pages—Retrieved from Internet: https://www.qrfs.com/blog/14-can-i-paint-my-fire-sprinkler-cover-plates/.

* cited by examiner

FIRE PROTECTION SPRINKLER CONCEALMENT ASSEMBLY HAVING AN EXTERNAL INDICIA

PRIORITY CLAIM & INCORPORATION BY REFERENCE

This application claims the benefit of U.S. Provisional Application No. 62/821,795 filed Mar. 21, 2019 which is incorporated by reference in its entirety.

TECHNICAL FIELD

The present invention relates generally to fire protection sprinkler accessories. In particular, the present invention is directed to preferred embodiments of a concealment assembly for fire protection sprinklers.

BACKGROUND ART

Automatic fire protection sprinklers and systems are used to protect a variety of indoor spaces, such as for example, office spaces, galleries or lounging areas. The fire protection sprinklers are coupled to fluid supply piping that runs behind the ceilings and wall. Through holes are formed in the ceilings and/or walls through which the sprinklers can extend, depending upon their installation orientation, and discharge a firefighting fluid upon sprinkler actuation and operation. These spaces are typically decorated with the ceiling and/or walls selected, painted or papered to match a design theme or color scheme. In order to preserve the decorative scheme or general appearance of the space being protected, it can be desirable to conceal the installed sprinklers, the through hole openings through which the sprinklers extend and the associated sprinkler system piping. Accordingly, cover plate assemblies are available to conceal an installed sprinkler and mount flush against a wall or ceiling to conceal the through hole opening.

Known cover plate assemblies include a tubular securement member and a cover plate or dome that is soldered to an annular flange of the securement member. The securement member engages a support cup that surrounds the installed sprinkler in order to couple the cover plate assembly to the support cup and house the sprinkler in between. The securement portion extends into the through hole to bring the flange and the cover plate adjacent to or flush to the wall or ceiling surface. In the completed installation, the cover plate or dome remains visible from the space being protected. In currently available cover plate assemblies, the cover plate can be customized to match a desired color scheme. A sprinkler system designer or installer can order the cover plate to be uniformly painted with a single customized color.

A cover plate assembly is a thermally responsive sprinkler system accessory defined by the solder connection between the securement member and the cover plate or dome. In the presence of a sufficiently large fire or thermal event, the solder connection fuses and the cover plate or dome separates from the securement member to expose the fire protection sprinkler to the heated atmosphere. As the heat increases to the rated temperature of the concealed sprinkler, the exposed sprinkler eventually actuates and discharges firefighting fluid to address the fire or thermal event. Accordingly, in order for the sprinkler system using concealed sprinklers to properly operate, it is important that the cover plate assemblies properly thermally respond and separate at their rated temperature.

Cover plate assemblies are generally subject to industry accepted fire code requirements and the approval of the "authority having jurisdiction" (AHJ) to ensure compliance with the applicable codes and requirements. One manner of satisfying the applicable requirements, is by identification of cover plate assemblies capable of proper thermal response through appropriate industry accepted corrosion and operating testing. To facilitate the AHJ approval process, fire protection equipment can be "listed," which as defined by NFPA 13, means that the equipment is included in a list by an organization that is acceptable to the AHJ and whose list states that the equipment "meets appropriate designated standards or has been tested and found suitable for a specified purpose." One such listing organization includes, Underwriters Laboratories Inc. ("UL"). UL Standard for Safety for Automatic Sprinklers for Fire-Protection Service UL 199 (11th ed. 2005, rev. 2008) ("UL 199") provides a thermal operating test for cover plate and sprinkler assemblies. Testing standards for cover plate assemblies are also available from FM Approvals LLC ("FM"). Such FM Approvals include: (i) "Approval Standard for Automatic Sprinklers for Fire Protection—Class Number 2000" (February 2018) ("FM 2000"); or (ii) "Approval Standard for Residential Sprinklers for Fire Protection—Class Number 2030" (August 2009) ("FM 2030"). In the particular case of the painted cover plates, it is necessary to ensure that the paint is applied so as not to adversely interfere with the thermal response and separation of the cover plate from the securement member. Accordingly, listing organizations require that painted cover plates be tested to verify that a paint coating specification can provide for a cover plate assembly that thermally responds and operates as intended. As used herein, "standardized thermal and exposure response tests for cover plate assemblies" include one or more of: (i) an Operating Temperature (Liquid Bath) Test; (ii) High Ambient Temperature Exposure (90 Day Test); and (iii) a multitude of corrosion Tests as defined in the FM and UL standards. Depending upon the particular tests, the cover plate assemblies are tested as an individual component or in an installed concealed sprinkler test arrangement.

Although listed custom painted cover plates are available, the available cover plate assemblies still present design limitations because the cover plates are only available in a single color. There is a desire to have cover plate assemblies in which the cover plate or dome has multiple colors that can be customized to with alphanumeric characters, text, logos designed patterns, symbols or other forms of indicia. Moreover, it would be necessary that such a multi-colored cover plate or dome would satisfy the thermal response requirements for the assembly as a whole.

DISCLOSURE OF INVENTION

A preferred concealment assembly and method is provided for fire protection sprinklers. The preferred assembly includes a cover member having a layered construction in which its constituent materials are disposed to provide proper thermal response and visual indicia for the complete concealment assembly. The preferred cover member includes a substrate with a continuous base polymer coating or layer on an external surface of the substrate with one or more different polymer coatings disposed in a discontinuous manner over the base polymer to provide the desired indicia. Disposed on the surface of the substrate opposite the base coating are one or more deposits of solder to define the thermal sensitivity and rating of the assembly. The top polymer coatings are disposed atop the base coating in a manner that does not adversely affect the thermal response and operation of the concealment assembly.

One preferred concealment assembly includes a tubular securement member having a first end and a second end spaced apart from one another along a central axis with the second end includes an annular flange. A preferred cover member and a plurality of solder connections between the cover member and the annular flange conceal the second end of the tubular securement member. The cover member includes a substrate having a first surface internal to the tubular securement member and a second surface external to the tubular securement member. A first continuous polymer layer is disposed on the external surface of the substrate and a second preferably discontinuous polymer layer is disposed on a portion on the first polymer layer.

Another preferred embodiment provides a system for concealing an installed fire protection sprinkler. The preferred system includes a cover member having a first substrate surface defining one or more solder regions and a second substrate surface defining an external surface of the concealment system that remains visible after concealing the installed sprinkler. A base layer of a first polymer is disposed over the second substrate surface with a portion of the base layer defining one or more logo zones off-set from the solder regions for applying a second polymer different than the first polymer.

Preferred methods of concealed fire protection are provided that include obtaining a concealment sub-assembly having a cover member defining an external surface that includes a base layer of a first polymer covering the external surface. The preferred method further includes providing indicia on the external surface with a second polymer that is disposed in a discontinuous layer on the base layer.

BRIEF DESCRIPTION OF DRAWINGS

The accompanying drawings, which are incorporated herein and constitute part of this specification, illustrate exemplary embodiments of the invention, and together, with the general description given above and the detailed description given below, serve to explain the features of the invention. It should be understood that the preferred embodiments are some examples of the invention as provided by the appended claims.

MODE(S) FOR CARRYING OUT THE INVENTION

Figure 1A:
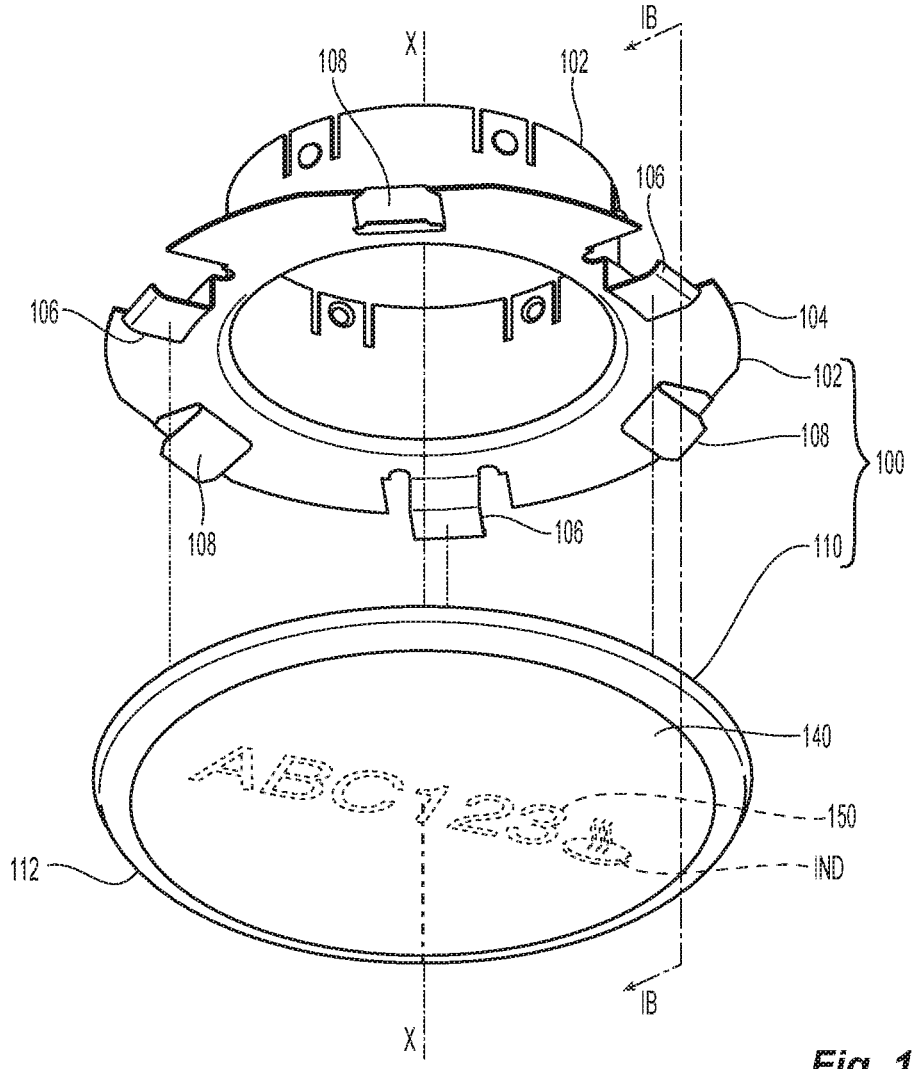
FIG. 1A is an exploded perspective view of a preferred fire protection sprinkler concealment assembly.
Figure 1B:
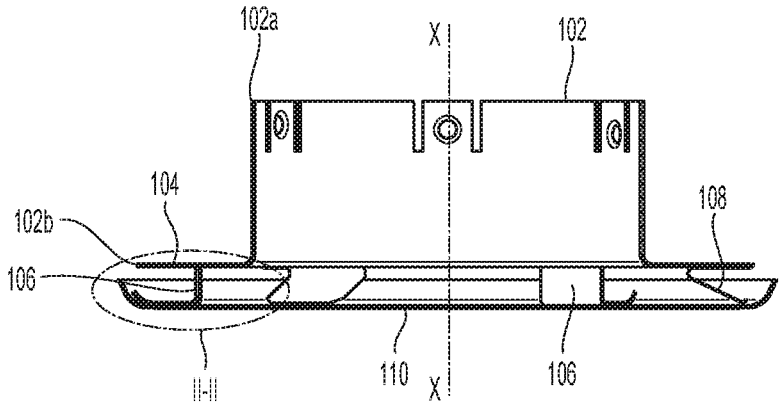
FIG. 1B is a cross-sectional view of the preferred concealment assembly of FIG. 1A.

Shown in FIGS. 1A and 1B are respective perspective and cross-sectional views of a preferred concealment assembly 100 for concealing an installed fire protection sprinkler for protection of a space or occupancy. The concealment assembly can be used to conceal a sprinkler in any one of a pendent or horizontal orientation. The preferred concealment assembly 100 includes one or more customized indicia IND applied to an exposed surface of the concealment assembly 100. The indicia can include one or more of an alpha numeric characters and/or pictures or symbols. Thus, the preferred indicia can be customized to convey information regarding the owners, operators, and/or occupants of the space being protected. Moreover, the indicia can be used to convey information about the function of the business or purpose of the protected space or that of its owners, operators, and/or occupants. Alternatively or additionally, the customized indicia can be coordinated with the surrounding décor of the space being protected. Examples of customizable indicia can include logos, slogans, numerical patterns, geometric patterns and/or icons.

The preferred concealment assembly 100 includes a preferably tubular securement member 102 and a preferred cover member 110 affixed to the securement member 102. The securement member 102 is preferably configured to engage and more preferably threadedly engage a support cup disposed about a fire protection sprinkler so as to conceal the sprinkler between the support cup and the cover member 110. For an installed sprinkler assembly coupled to a supply pipe fitting behind a wall or ceiling, the engagement between the sprinkler support cup and the securement member 102 locates the cover member 110 so that it covers the through hole and conceals the installed sprinkler assembly and associated supply piping behind the wall. The preferred tubular securement member 102 has a first end 102*a* and a second end 102*b* spaced apart from one another along a central axis X-X. The second end 102*b* of the securement member 102 preferably includes an annular flange 104 formed or disposed about the second end 102*b* of the securement member.

The cover member 110 is affixed to the annular flange 104 of the securement member 102 by a thermally responsive material such as, for example, a fusible solder. To form one or more soldered connections, the flange 104 preferably includes a plurality of angled connectors 106 angularly spaced about the central axis X-X to which the cover member 110 can be soldered. In the event of a fire or sufficient level of heat, the solder fuses at its rated thermal temperature and the cover member 110 separates from the rest of the concealment assembly 100 to expose the installed sprinkler assembly (not shown) housed therein to discharge and distribute a firefighting fluid to address the fire or other thermal event. To facilitate separation, the flange preferably includes a plurality of separating spring members 108 equiangularly spaced about the central axis X-X. Accordingly, in order for a concealed sprinkler 10 to effectively address a fire, the preferred cover member 110 is constructed in a manner to provide for proper thermal separation of the cover plate member 110 from the securement member 102.

The preferred cover member 110 is a layered construction in which its constituent materials are disposed relative to one another to fulfill the following functions: proper thermal response and provide visual indicia. In a preferred aspect with respect to FIG. 1, the cover member 110 includes a substrate 112 with a base polymer coating or layer 140 on an external surface with one or more different polymer coatings 150 formulated and layered over the base polymer coating 140 to provide the desired indicia IND. Disposed on a surface of the substrate opposite the base coating 140 are one or more deposits of solder for joining the cover member 110 to the annular flange 104 of the securement member 102. In the preferred embodiments, a solder deposit is applied between the substrate 112 and each angled connector 106 located along the annular flange to form the soldered connections. The top polymer coatings 150 are disposed atop the base coating 140 in a manner that does not adversely affect the thermal response and operation of the concealment assembly 100.

Figure 2:
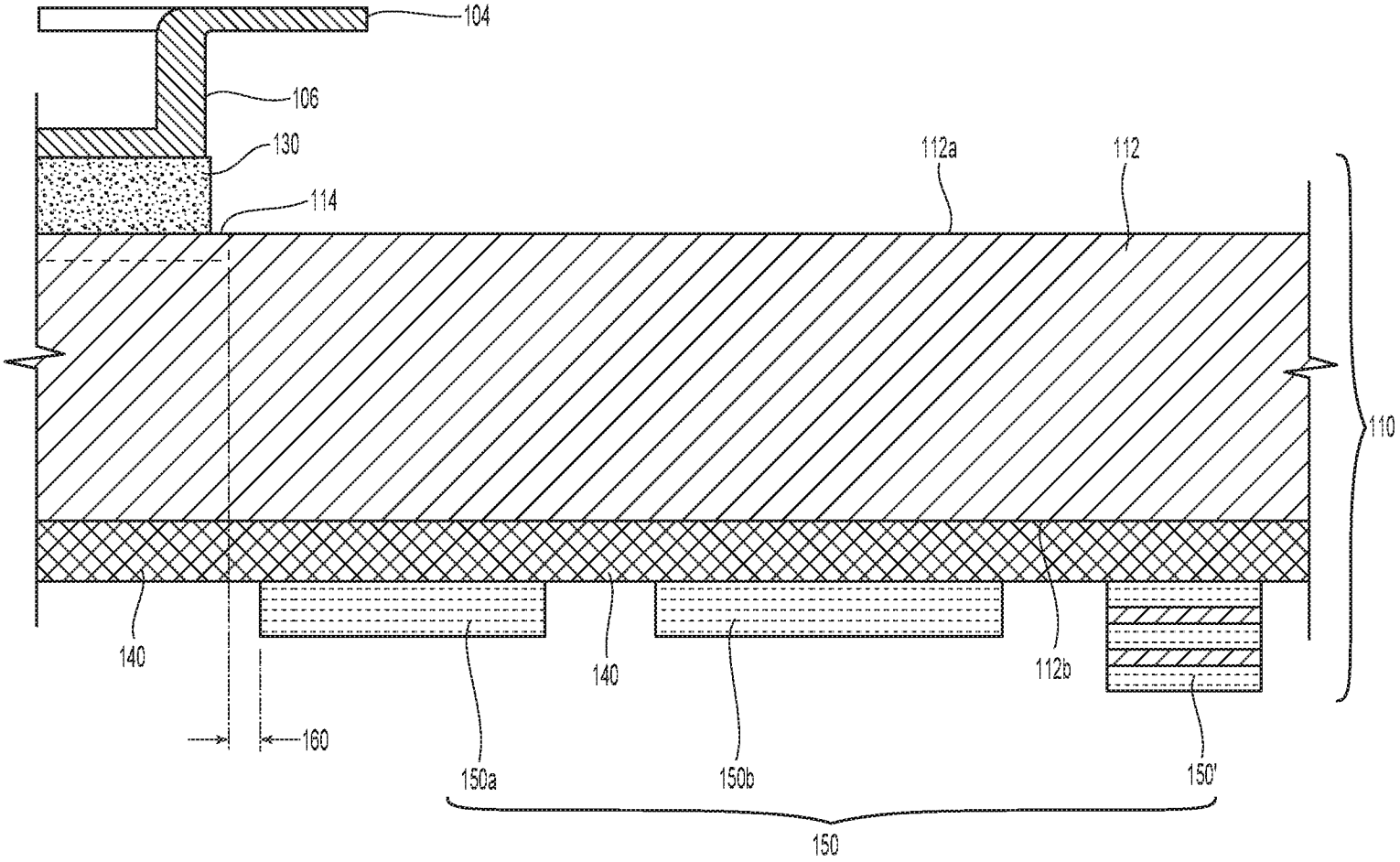
FIG. 2 is a schematic view of a portion of the cross-section II-II in FIG. 1B.

Shown in FIG. 2 is an illustrative sectional view of a preferred embodiment of the preferred cover member 110. The base substrate 112 is preferably formed from a metal alloy, preferably any one of copper, brass, or stainless steel. The substrate 112 defines a first internal surface 112*a* that is shown soldered to a connector 106 to confront the annular flange 104 of the securement member 102. Schematically shown is a solder deposit 130 for joining the cover member 110 to the connector 106 and flange 104. The solder deposit 130 is preferably disposed on a defined solder region 114 of the first substrate surface 112*a* that is preferably located at a periphery of the first substrate surface 112*a*. The solder region 114 preferably defines an area larger than that of the solder deposit 130. Moreover, the first surface 112*a* preferably includes a plurality of solder regions 114 that are preferably equiangularly disposed about a geometric center of the substrate 112 which is preferably coaxially aligned with the center of the tubular securement member 102.

The substrate 112 includes a second surface 112*b* that is opposite and spaced from the first internal surface 112*a* over the thickness of the substrate 112. The second surface 112*b* of the substrate defines the external surface of the concealment assembly 100 that remains visible from the area being protected. Preferably disposed on the second surface 112*b* is a base coating of flowable and curable polymer 140. The base polymer 140 is preferably continuously applied over the entire second surface 112*b* and preferably to a uniform thickness. The base polymer 140 is preferably a paint such as, for example, a latex paint or other form of paint described herein. With the securement member 102 soldered to the first substrate surface 112*a* and the base coating of polymer 140 applied to the second substrate surface 112*b*, the concealment sub-assembly defines the preferred rating of the concealment assembly 110 defining the temperature at which the solder fuse and the cover member 110 will separate from the securement member 102. In a preferred aspect, the concealment sub-assembly defines a temperature rating ranging from 125° F. to 175° F. and is preferably nominally rated to one of 135° F. or 165° F.

A second flowable and curable polymer layer 150, different than the first base polymer layer 140, is preferably disposed upon the base polymer layer 140. The second polymer can be another paint or ink of a different color than the first polymer 140 that can adhere to the base layer 140. In one preferred embodiment, the first polymer layer 140 can be of a first color disposed on an entire area of the second substrate surface 112*b* and the second polymer layer 150 can be a second color different than the first color and disposed on a portion on the first polymer layer 140. Moreover, the second polymer layer 150 can include a plurality of polymers of different colors. As seen in FIG. 2, the second polymer layer is preferably applied to define space between adjacent portions 150*a*, 150*b* of the second polymer 150, or portions thereof, to expose the base polymer layer 140 and provide a discontinuous layer of the second polymer layer 150. As described herein, the second polymer layer 150 is preferably applied to a thickness equal to or greater than that of the base polymer layer 140. For example, in one preferred embodiment, the second polymer layer 150 is applied to the first polymer layer 140 to a material thickness that ranges from 1 to 3 times the thickness of the first polymer layer 140. Additionally, the portions of second polymer 150*a*, 150*b* can be applied at similar thicknesses or varying thicknesses over the base layer 140. Moreover, each application of the second polymer 150 atop the base coating 140 can be applied in a single layer 150*a*, 150*b* or alternatively applied in stacked layers 150' in which an underlying layer of the second polymer 150 is permitted to cure before applying the next.

Preferably interleaving of the first polymer 140 between the discontinuous second polymers 150 provides for a visual contrast that is visible preferably at a distance of over three feet. Accordingly, the second polymer layer 150 is preferably disposed in a preferred discontinuous manner over the first continuous base layer 140 to provide one or more indicia IND. The second polymer 150 can be applied in the form of alphanumeric characters, patterns, shapes or symbols that are visible at a distance of over three feet. More particularly the indicia IND is visible to those within the space being protected by an installed sprinkler concealed by the preferred concealment assembly 100. As previously noted, the indicia IND can be in the form of logos, slogans, numerical patterns, geometric patterns and/or icons.

In addition to the discontinuous application of the second polymer, the second polymer layer 150 is preferably disposed on the base coating 140 so as to be off-set from a solder region 114 such that application of the second polymer 150 does not overlap and therefore distinct from a solder region 114 in a direction normal to the surfaces 112*a*, 112*b* of the substrate 112. By off-setting application of the second polymer 150 from the solder regions 130, one or more barrier spaces 160 are defined over the thickness of the substrate 112 in which there is neither solder nor second polymer 150. The preferred off-set of the second polymer minimizes and more preferably eliminate any adverse impact of the second polymer 150 on the thermal responsiveness and/or temperature rating of the concealment assembly 100. The second polymer 150 causes a variation of no more than 5% in the thermal rating of the concealment sub-assembly formed by the securement member 102 soldered to the first substrate surface 112*a* and the base coating of polymer 140 applied to the second substrate surface 112*b*. Inventors have determined that the discontinuous second polymer layer 150 permits sufficient heat transfer to the underlying arrangement base coating 140, substrate 112, solder regions 114 and solder deposit 130 in the event of a fire or sufficient thermal event to fuse the solder deposit 130 and permit separation of the cover member 110 from the securement member 102 in a manner consistent with the assembly's 100 thermal rating. Accordingly, there are preferred geometric relationships and/or ratios between the second polymer layer 150 and the rest of the cover member 110 that provide for both a desired thermal response and visual indicia IND to the complete concealment assembly 100. In particular, preferred embodiments of the concealment assembly and methods of fire sprinkler concealment include two or more overlaying visually contrasting polymers which define a preferred ratio in polymer thicknesses that provides a thermal response consistent with a nominal thermal rating of the concealment assembly.

Shown in FIGS. 3A-3D are various preferred embodiments of the cover member 110 having a preferred zone of indicia or logo zone 170 in which the second polymer layer 150 can be disposed. Within the logo zone 170, the second polymer can also be applied in the preferred discontinuous manner to form a desired indicia IND as previously described. The preferred logo zone 170 covers a portion of the first base polymer layer 140 and is preferably off-set from the solder regions 114. In each embodiment shown, the preferred logo zone 170 is preferably of an area less than the base layer 140 so as to provide for the preferred discontinuous second polymer 150. In a preferred aspect, the second polymer layer 150 defines a surface area of no more than 50% of the first polymer surface layer; and more preferably, the logo zone 170 in which the second polymer layer 150 can be disposed is preferably, at a maximum, 50% of the surface area of the base layer 140. In another preferred embodiment, the logo zone 170 is preferably is no more than 30% of the surface area of the base layer 140. In yet another preferred embodiment, the logo zone 170 is preferably is no more than 20% of the surface area of the base layer 140.

Figure 3A:
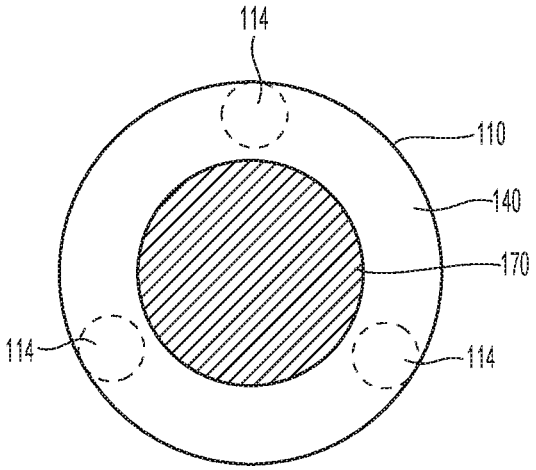
FIGS. 3A-3D are schematic illustrative views of alternate preferred embodiments of a cover plate member for use in the concealment assembly of FIGS. 1A-1B.
Figure 3B:
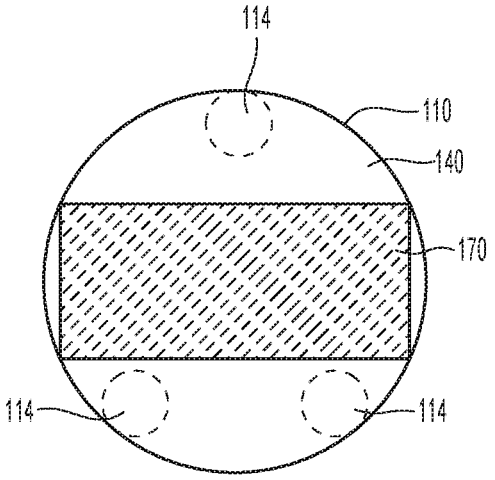
Figure 3C:
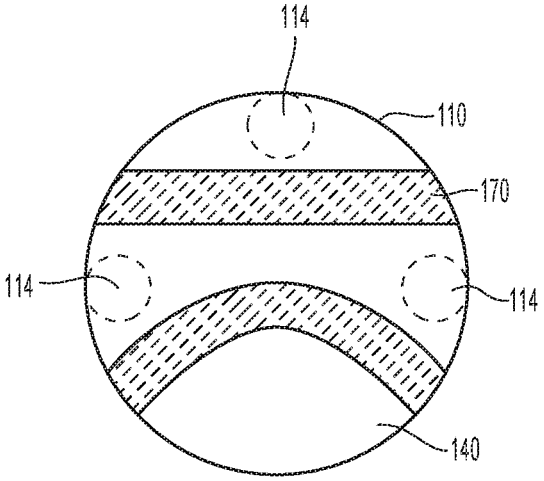
Figure 3D:
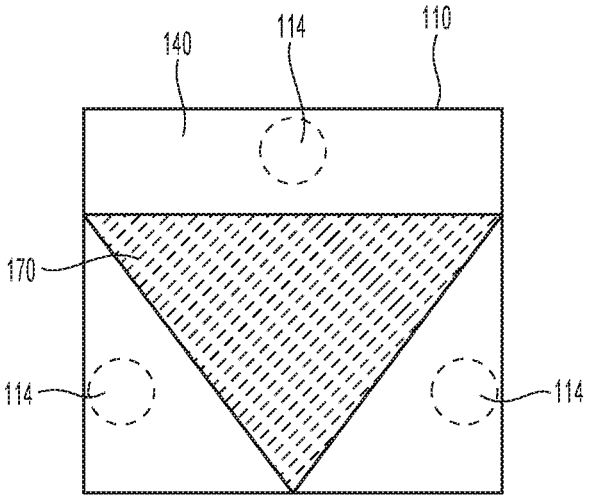

The area of the base layer is preferably equivalent to the area surrounded by the perimeter of the underlying substrate 112 defining the shape of the cover member 110. As seen in FIGS. 3A-3C, the cover member 110 can be circular but can be rectilinear as seen in FIG. 3D. Alternate geometries are also possible in which the edges of the cover member are linear, arcuate or a combination thereof. Furthermore, although the substrate 112 in each embodiment show is substantially planar, the substrate can have more height or depth to define in internal volume to house a portion of a fire sprinkler. Accordingly, the substrate can be domed or cylindrical in shape. In a preferred embodiment, the cover member is circular with a diameter of about three inches (3.3 in.) to define an area covered by the base polymer 140 of about 8.5 square inches (8.5 sq. in.). In the preferred embodiments, the logo zone can be about 6.4 sq. in. As seen in FIGS. 3A, 3B and 3D, the logo zone 170 can be circular, rectilinear, triangular or a combination thereof. Moreover, the logo zone 170 can be defined by a multiple logo zones 170 as seen in FIG. 3C.

A preferred method of forming the concealment assembly 100 includes applying the second polymer 150 by a preferred screening printing process. Alternative methods can include applying the second polymer 150 using, for example, using a 3-D printer, spray painting or other application techniques. A preferred soldered sub-assembly of the securement portion 102 and coated substrate 112 is initially provided. The soldered sub-assembly defines a preferred temperature rating that ranges from 125° F. to 175° F. and is preferably nominally rated to one of 135° F. or 165° F. In the soldered sub-assembly, the substrate 112 is coated with a base polymer 140 of paint to a thickness that satisfies the desired visual color requirement for the applied paint and satisfies the temperature rating of the soldered sub-assembly. The paint coating can be any one of an acrylic, acrylic latex, alkyd enamel, catalyzed epoxy, enamel, lacquer, latex and urethane.

The soldered sub-assembly is subjected to the preferred screen printing process to apply the second polymer layer 150 to the base paint or polymer 140. A print screen is configured with a desired indicia IND form and placed over the sub-assembly and its external surface with the base polymer 140. A preferred second polymer 150, embodied as an appropriate screen printing ink, is applied to the print screen and transferred to the sub-assembly using an appropriate technique to move the ink from the print screen to the base polymer 140. The second polymer 150 is applied to the base polymer 140 to a thickness that is preferably equal to or greater than that of the base polymer 140. More preferably, the second polymer 150 is applied to a thickness that ranges from 1 to 3 times the thickness of the base polymer 140 and more preferably 2.5 times the thickness of the base polymer 140. Alternative embodiments of the assembly can have a second polymer at a thickness less than the first base polymer provided that the second polymer provides sufficient visual contrast to the base polymer and satisfy the thermal response requirements of the assembly.

A preferred screen printing ink for the second polymer 150 is a permanent epoxy-based ink mixed with a catalyst defining a preferred cure temperature, rate, pot life and/or shelf life. The cure temperature of the ink is preferably less than the nominal temperature rating of the soldered sub-assembly and more preferably at its maximum 25-40% lower than the nominal temperature rating of the soldered sub-assembly. The applied ink 150 can be cured to a single layer. In an alternate embodiment of the process, the ink can be applied in layers up to a maximum of five layers in which a layer is permitted to cure before applying a subsequent to layer. Examples of preferred inks for use include permanent, two-component, epoxy-based screen printing inks mixed with a catalyst to cure at a preferred cure temperature. A preferred catalyst permits the ink to cure under heat to reduce the time to cure. A preferred ink and catalyst mix can also limit pot life which can limit yield on producing the preferred concealing assemblies. Thus, the ink and catalyst mixture preferably balances the cure temperature and time with the pot life to yield a desired number of assemblies for a given volume of ink.

To verify that the ink is applied in a desired manner, the resulting indicia is verified for visual quality. In addition, the concealment assembly 100 is preferably subjected to one or more of the standardized thermal and exposure response test for cover plate assemblies. The test(s) can be used to verify that the print screening process did not result in a significant variation of the temperature rating of the sub-assembly. More preferably, any resultant temperature variation is no more than 5%. Thus, the concealment assembly and methods of fire sprinkler concealment can provide two or more overlaying visually contrasting polymers that define a thermal response consistent with a nominal thermal rating of the concealment assembly.

The preferred embodiments of concealment assembly provide preferred methods of providing a concealed fire protection sprinkler installation. A preferred method of includes obtaining a concealment assembly with a cover member having at least two visually contrasting polymer layers. Obtaining a fire protection sprinkler can include any one of manufacturing, acquiring, testing and/or purchasing the assembly. The method further preferably includes distributing the concealment assembly for installation which preferably includes giving, supplying, and/or selling the sprinkler for installation and use in a concealed sprinkler arrangement.

While the present invention has been disclosed with reference to certain embodiments, numerous modifications, alterations, and changes to the described embodiments are possible without departing from the sphere and scope of the present invention, as defined in the appended claims. Accordingly, it is intended that the present invention not be limited to the described embodiments, but that it has the full scope defined by the language of the following claims, and equivalents thereof.

What is claimed is:

1. A concealment assembly for concealing a fire protection sprinkler assembly, the concealment assembly comprising:

a tubular securement member having a first end and a second end spaced apart from one another along a central axis, the second end including an annular flange;

a cover member; and a plurality of solder connections between the cover member and the annular flange to conceal the second end of the tubular securement member, the cover member including:

a substrate having a first surface internal to the tubular securement member and a second surface external to the tubular securement member;

a first continuous polymer layer disposed on the second surface of the substrate; and a second discontinuous polymer layer disposed on a portion on the first polymer layer.

2. The concealment assembly of claim 1, wherein the first and the second polymer layers are of different colors, a first polymer layer of a first color disposed on an entire area of the second surface of the substrate; and a second polymer layer of a second color disposed on a portion on the first polymer layer.

3. The concealment assembly of claim 1, wherein the plurality of solder connections contacts the cover plate member to define a plurality of solder regions on the first polymer layer, the portion on the first polymer layer having the second polymer layer disposed thereon defines a zone of indicia on the first polymer layer that is distinct from the plurality of solder regions.

4. The concealment assembly of claim 3, wherein the second polymer layer defines indicia being any one of: an alpha numeric logo, a symbol, an icon, a pattern, or combination thereof.

5. The concealment assembly of claim 4, wherein the indicia comprises an alpha numeric logo.

6. The concealment assembly of claim 2, wherein the plurality of solder connections is equiangularly disposed about the central axis, the zone of indicia being radially inward of the solder connections.

7. The concealment assembly of claim 5, wherein the zone of indicia is circular.

8. The concealment assembly of claim 5, wherein the zone of indicia is rectangular.

9. The concealment assembly of claim 5, wherein the zone of indicia includes a plurality of zones of indicia.

10. The concealment assembly of claim 1, wherein the first polymer comprises a paint and the second polymer comprises a screen printing ink.

11. The concealment assembly of claim 9, wherein the second polymer of ink comprises of up to five layers of ink.

12. The concealment assembly of claim 1, wherein the solder connections and first polymer define a nominal temperature rating and the second polymer varying the temperature rating no more than 5%.

13. The concealment assembly of claim 1, wherein the concealment assembly satisfies a standardized thermal and exposure response test.

14. The concealment assembly of claim 1, wherein the second polymer layer is applied to the first polymer to a material thickness that ranges from 1 to 3 times a thickness of the first polymer.

15. The cover plate assembly of claim 1, wherein the first polymer layer defines a first surface area, the second polymer layer defines a surface area of no more than 50% of the first polymer surface layer.

16. The cover plate assembly of claim 15, wherein the surface area of the second polymer layer is no more than 30% of the first polymer surface layer.

17. The cover plate assembly of claim 16, wherein the surface area of the second polymer layer is no more than 20% of the first polymer surface layer.

18. A system for concealing an installed fire protection sprinkler, the system comprising:

a cover member having a first substrate surface defining at least one solder region and a second substrate surface defining an external surface of the concealment system that remains visible after concealing the installed sprinkler; and a base layer of a first polymer disposed over the second substrate surface, a portion of the second base layer defining at least one logo zone off-set from the at least one solder region for applying a second polymer different than the first polymer.

19. The system of claim 18, including a securement member for engaging a sprinkler support cup and a solder deposit disposed within the at least one solder region to couple the cover member to the securement member.

20. The system of claim 18, wherein the logo zone is an area less than an area defined by the base layer.

21. The system of claim 20, wherein the logo zone is 50% of the area defined by the base layer.

22. The system of claim 21, wherein the logo zone is no more than 30% of the area defined by the base layer.

23. The system of claim 22, wherein the logo zone is no more than 20% of the area defined by the base layer.

24. The system of claim 18, wherein the at least one solder region includes a plurality of solder regions and the at least one logo zone defines a plurality of logo zones, the plurality of logo zones being off-set from each of the plurality of solder regions.

25. The system of claim 18, wherein the cover member has a perimeter defining any one of a circular or rectilinear shape, the logo zone being centered within the perimeter.

26. The system of claim 25, wherein the logo zone is circular.

27. The system of claim 18, wherein the cover plate assembly satisfies a standardized thermal and exposure response test.

* * * * *